US010957506B2

(12) United States Patent
Nakayama

(10) Patent No.: US 10,957,506 B2
(45) Date of Patent: Mar. 23, 2021

(54) CONTROLLER, DISTRIBUTED POWER SUPPLY, AND METHOD FOR CHECKING FOR WELDING

(71) Applicant: KYOCERA Corporation, Kyoto (JP)

(72) Inventor: Shusuke Nakayama, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/637,273

(22) PCT Filed: Aug. 7, 2018

(86) PCT No.: PCT/JP2018/029642
§ 371 (c)(1),
(2) Date: Feb. 7, 2020

(87) PCT Pub. No.: WO2019/044428
PCT Pub. Date: Mar. 7, 2019

(65) Prior Publication Data

US 2020/0185175 A1 Jun. 11, 2020

(30) Foreign Application Priority Data

Aug. 28, 2017 (JP) ..... JP2017-163542

(51) Int. Cl.
*H01H 47/00* (2006.01)

(52) U.S. Cl.
CPC ..... *H01H 47/005* (2013.01); *H01H 2047/003* (2013.01)

(58) Field of Classification Search
CPC ..... H01H 1/0015; H01H 1/18; H01H 1/2083; H01H 1/605; H01H 1/62; H01H 2009/544–546; H01H 2071/044; H01H 2239/036; H01H 2300/018; H01H 2300/052; H01H 33/59; H01H 33/596; H01H 45/04; H01H 45/12; H01H 47/02; H01H 47/22; H01H 47/00; H01H 47/002; H01H 47/004–005; H01H 50/04; H01H 50/12; H01H 50/546; H01H 9/40; H01H 9/42; H01H 9/54; H01H 9/56; H01H 9/542; H01H 9/548; H01H 83/02; H01H 83/144; H01H 71/501; H01H 2047/003; H01H 13/64
See application file for complete search history.

(56) References Cited

U.S. PATENT DOCUMENTS

2016/0087426 A1* 3/2016 Kuranuki ..... H02H 7/1216 363/34

FOREIGN PATENT DOCUMENTS

JP 2010-225418 A 10/2010

* cited by examiner

*Primary Examiner* — Bryan R Perez
(74) *Attorney, Agent, or Firm* — Hauptman Ham, LLP

(57) ABSTRACT

A controller 10 performs a first welding check and a second welding check in any order, and then performs a third welding check before a fourth welding check and also performs a fifth welding check before a sixth welding check. The first welding check is performed by turning on a first relay 18. The second welding check is performed by turning on a second relay 19. The third welding check is performed by turning on an in-phase relay, a third relay 20, and a fourth relay 21. The fourth welding check is performed by turning on an out-of-phase relay, the third relay 20, and the fourth relay 21. The fifth welding check is performed by turning on the in-phase relay, a fifth relay 22, and a sixth relay 23. The sixth welding check is performed by turning on the out-of-phase relay, the fifth relay 22, and the sixth relay 23.

7 Claims, 5 Drawing Sheets

CONTROLLER, DISTRIBUTED POWER SUPPLY, AND METHOD FOR CHECKING FOR WELDING

CROSS REFERENCE TO RELATED APPLICATION

This application is a national phase of International application No. PCT/JP2018/029642, filed Aug. 7, 2018, which claims priority to and the benefit of Japanese Patent Application No. 2017-163542 filed on Aug. 28, 2017.

TECHNICAL FIELD

The present disclosure relates to a controller, a distributed power supply, and a method for checking for welding.

BACKGROUND

Relays are used to turn on and off electrical connections to load apparatuses from a power source such as a fuel cell. However, if, for example, a phenomenon which generates heat, such as overcurrent, occurs in a relay, switching of the relay may not operate as normal due to melting and welding in the relay. Thus, it is desirable to determine whether such welding has occurred in the relay. Occurrence of welding in a relay can be determined based on a change in a potential difference between contact terminals at the time of turning on and off the relay. Also, the occurrence of welding in a relay can be determined based on a current value at a current sensor in the path of current flowing through the relay when the relay is turned off (see PTL 1).

CITATION LIST

Patent Literature

PTL 1: JP-A-2010-225418

SUMMARY

Technical Problem

A power source can be used as a distributed power supply for supplying electric power, together with a commercial power grid, to load apparatuses in a customer facility. The distributed power supply is connected to an electrically conductive path to the load apparatuses from the commercial power grid via an interconnecting relay. An auxiliary connector relay and an auxiliary independent relay are connected to an auxiliary apparatus serving as a specific load apparatus in the customer facility, such that the auxiliary apparatus can receive electric power from the commercial power grid and the distributed power supply without passing through the electrically conductive path.

In a configuration using a plurality of relays as described above, when the method described in PTL 1 or the method based on a potential difference as described above are used to determination the occurrence of welding in the relays, it is necessary to provide a number of current sensors or voltage sensors which accords to the number of relays. Providing a plurality of sensors which accords to the number of relays increases the manufacturing cost.

Accordingly, in consideration of the above problem with such conventional techniques, an object of the present disclosure is to provide a controller, a distributed power supply, and a method for determining whether welding has occurred in any one of a plurality of relays using detection results from fewer sensors than are conventionally used.

Solution to Problem

In order to solve the problem described above, a controller according to a first aspect is a controller capable of controlling turning on and off of a first relay, a second relay, a third relay, a fourth relay, a fifth relay, and a sixth relay. The first relay is provided between a first output terminal of an AC power supply and a U-phase terminal. The U-phase terminal is connected to power grid. The second relay is provided between a second output terminal and a W-phase terminal. The second output terminal has a different polarity from the first output terminal. The W-phase terminal is connected to the power grid. The third relay is provided between a first auxiliary terminal and the U-phase terminal or the W-phase terminal. The first auxiliary terminal is connected to an auxiliary apparatus. The fourth relay is provided between a second auxiliary terminal and an O-phase terminal. The second auxiliary terminal has a different polarity from the first auxiliary terminal. The O-phase terminal is connected to the power grid. The fifth relay is provided between the first output terminal and the first auxiliary terminal. The sixth relay is provided between the second output terminal and the second auxiliary terminal. The controller according to the first aspect performs a first welding check and a second welding check, in any order. Then, the controller performs a third welding check before a fourth welding check, and also performs a fifth welding check before a sixth welding check. The first welding check is performed by turning on the first relay. The second welding check is performed by turning on the second relay. The third welding check is performed by turning on an in-phase relay, the third relay, and the fourth relay. The in-phase relay is one of the first relay and the second relay that is connected to the U-phase terminal or the W-phase terminal, together with the third relay. The fourth welding check is performed by turning on an out-of-phase relay, the third relay, and the fourth relay. The out-of-phase relay is one of the first relay and the second relay that is not the in-phase relay. The fifth welding check is performed by turning on the in-phase relay, the fifth relay, and the sixth relay. The sixth welding check is performed by turning on the out-of-phase relay, the fifth relay, and the sixth relay.

A distributed power supply according to a second aspect includes an AC power supply, a U-phase terminal, a W-phase terminal, an O-phase terminal, a first auxiliary terminal, a second auxiliary terminal, a first relay, a second relay, a third relay, a fourth relay, a fifth relay, a sixth relay, and a controller. The AC power supply includes a first output terminal and a second output terminal. The second output terminal has a different polarity from the first output terminal. The U-phase terminal, the W-phase terminal, and the O-phase terminal are connected to power grid. The first auxiliary terminal is connected to an auxiliary apparatus. The second auxiliary terminal has a different polarity from the first auxiliary terminal. The first relay is provided between the first output terminal and the U-phase terminal. The second relay is provided between the second output terminal and the W-phase terminal. The third relay is provided between the first auxiliary terminal and the U-phase terminal or the W-phase terminal. The fourth relay is provided between the second auxiliary terminal and the O-phase terminal. The fifth relay is provided between the first output terminal and the first auxiliary terminal. The sixth relay is provided between the second output terminal and the second auxiliary terminal. The controller performs a first welding check and a second welding check, in any order. Then, the controller performs a third welding check before a fourth welding check, and also performs a fifth welding check before a sixth welding check. The first welding check is performed by turning on the first relay. The second welding check is performed by turning on the second relay. The third welding check is performed by turning on an in-phase relay, the third relay, and the fourth relay. The in-phase relay is one of the first relay and the second relay that is connected to the U-phase terminal or the W-phase terminal, together with the third relay. The fourth welding check is performed by turning on an out-of-phase relay, the third relay, and the fourth relay. The out-of-phase relay is one of the first relay and the second relay that is not the in-phase relay. The fifth welding check is performed by turning on the in-phase relay, the fifth relay, and the sixth relay. The sixth welding check is performed by turning on the out-of-phase relay, the fifth relay, and the sixth relay.

Although the apparatus and the system have been described above as the solutions of the present disclosure, it should be appreciated that the present disclosure may also be realized by an embodiment that includes the apparatus or the system, a method, a program, and a storage medium storing the program which are substantially correspond to the apparatus or the system, and that all of which are included in the scope of the present disclosure.

For example, a method for checking welding that realizes a third aspect is a method for checking welding of a first relay, a second relay, a third relay, a fourth relay, a fifth relay, and a sixth relay. The method includes a step of performing a first welding check and a second welding check, in any order, and then performing a third welding check before a fourth welding check, and a fifth welding check before a sixth welding check. The first relay is provided between a first output terminal of an AC power supply and a U-phase terminal connected to power grid. The second relay is provided between a second output terminal and a W-phase terminal. The second output terminal has a different polarity from the first output terminal. The W-phase terminal is connected to the power grid. The third relay is provided between a first auxiliary terminal and the U-phase terminal or the W-phase terminal. The first auxiliary terminal is connected to an auxiliary apparatus. The fourth relay is provided between the second auxiliary terminal and an O-phase terminal. The second auxiliary terminal has a different polarity from the first auxiliary terminal. The O-phase terminal is connected to the power grid. The fifth relay is provided between the first output terminal and the first auxiliary terminal. The sixth relay is provided between the second output terminal and the second auxiliary terminal. The first welding check is performed by turning on the first relay. The second welding check is performed by turning on the second relay. The third welding check is performed by turning on an in-phase relay, the third relay, and the fourth relay. The in-phase relay is one of the first relay and the second relay that is connected to the U-phase terminal or the W-phase terminal, together with the third relay. The fourth welding check is performed by turning on an out-of-phase relay, the third relay, and the fourth relay. The out-of-phase relay is one of the first relay and the second relay that is not the in-phase relay. The fifth welding check is performed by turning on the in-phase relay, the fifth relay, and the sixth relay. The sixth welding check is performed by turning on the out-of-phase relay, the fifth relay, and the sixth relay.

DETAILED DESCRIPTION

Hereinafter, an embodiment of a controller according to the present disclosure will be described with reference to the accompanying drawings.

Figure 1:
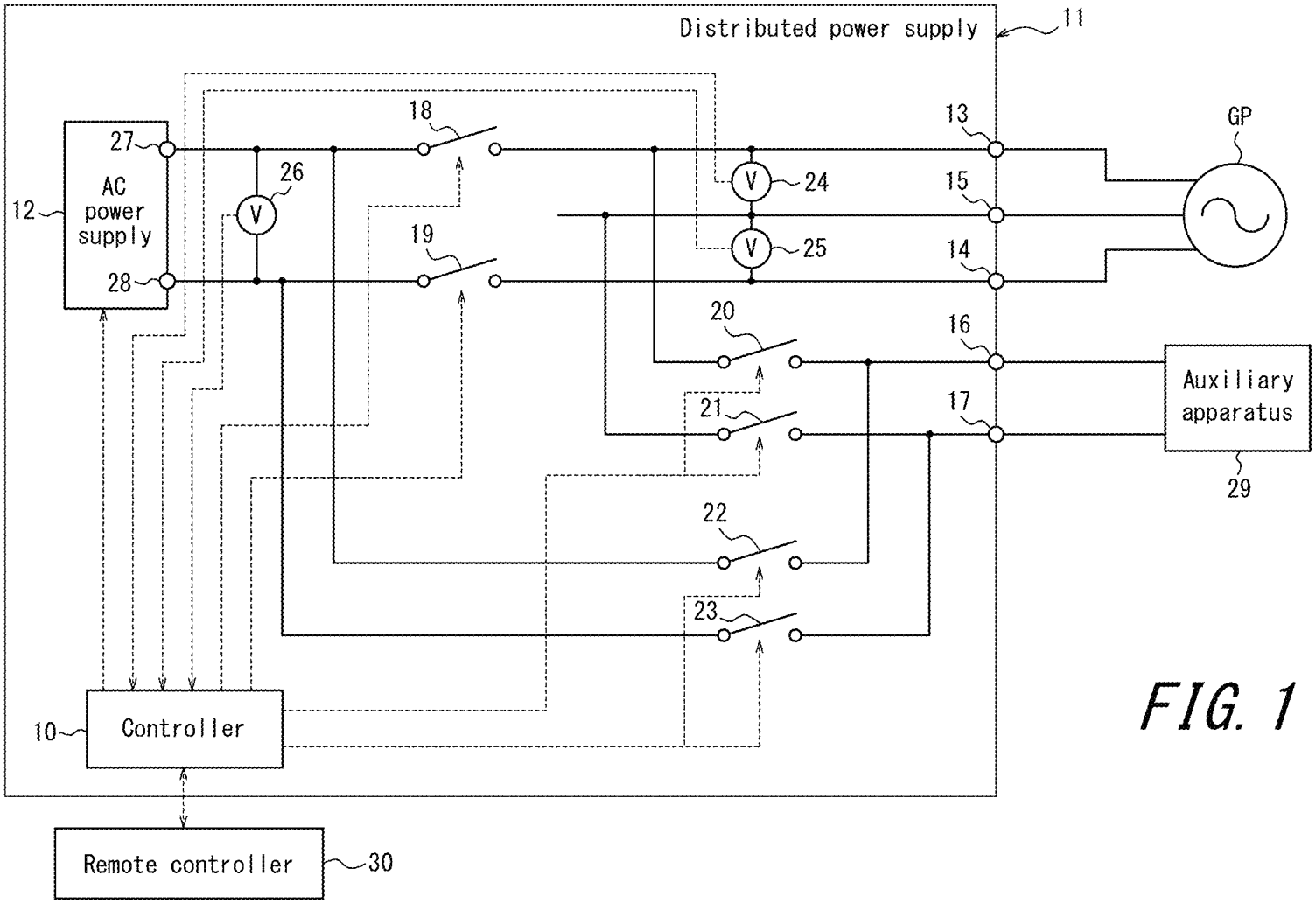
FIG. 1 is a functional block diagram illustrating a schematic configuration of a distributed power supply according to an embodiment.

As illustrated in FIG. 1, a distributed power supply 11, that includes a controller 10 according to an embodiment of the present disclosure, includes an AC power supply 12, a U-phase terminal 13, a W-phase terminal 14, an O-phase terminal 15, a first auxiliary terminal 16, a second auxiliary terminal 17, a first relay 18, a second relay 19, a third relay 20, a fourth relay 21, a fifth relay 22, a sixth relay 23, a first voltage sensor 24, a second voltage sensor 25, a third voltage sensor 26, and the controller 10. In the drawings described below, solid lines connecting functional blocks indicate power flow. In FIG. 1, dashed lines connecting functional blocks indicate flow of a control signal or communicated information. Communication indicated by broken lines may be wired communication or wireless communication.

The AC power supply 12 includes a first output terminal 27 and a second output terminal 28. The polarity of the second output terminal 28 is different from that of the first output terminal 27. The AC power supply 12 outputs AC power having an adjusted current or voltage, via the first output terminal 27 and the second output terminal 28. The AC power supply 12 includes a power supply capable of outputting DC power such as, for example, a fuel cell, a solar cell, and a rechargeable battery, and also includes an inverter circuit. The AC power supply 12 further includes, for example, a power source capable of outputting AC power such as, for example, a turbine generator, which is used in wind power generation or the like, and a voltage control circuit.

The U-phase terminal 13, the W-phase terminal 14, and the O-phase terminal 15 are connected to power grid GP. In particular, the U-phase terminal 13, the W-phase terminal 14, and the O-phase terminal 15 are respectively connected to a power supply line from the power grid GP to the U-phase terminal, the W-phase terminal, and the O-phase terminal of a distribution board in a consumer facility. The distributed power supply 11 supplies electric power to the customer facility via the U-phase terminal 13, the W-phase terminal 14, and the O-phase terminal 15.

The first auxiliary terminal 16 and the second auxiliary terminal 17 are connected to an auxiliary apparatus 29. The polarity of the second auxiliary terminal 17 is different from that of the first auxiliary terminal 16. The auxiliary apparatus 29 is a particular load apparatus that operates on electrical power supplied from the power grid GP and, when the power grid GP stops supplying AC power due to power outage or the like, operates on AC power supplied from the distributed power supply 11.

The first relay 18 is, for example, an electromagnetic relay. The first relay 18 is provided between the first output terminal 27 and the U-phase terminal 13. The first relay 18, based on control by the controller 10, turns on and off the electrical connection between the first output terminal 27 and the U-phase terminal 13.

The second relay 19 is, for example, an electromagnetic relay. The second relay 19 is provided between the second output terminal 28 and the W-phase terminal 14. The second relay 19, based on control by the controller 10, turns on and off the electrical connection between the second output terminal 28 and the W-phase terminal 14.

The third relay 20 is, for example, an electromagnetic relay. The third relay 20 is provided between the first auxiliary terminal 16 and the U-phase terminal 13 or the W-phase terminal 14. In the present embodiment, the third relay 20 is provided between the first auxiliary terminal 16 and the U-phase terminal 13, by way of example. The third relay 20, based on control by the controller 10, turns on and off the electrical connection between the first auxiliary terminal 16 and the U-phase terminal 13 or the W-phase terminal 14.

The fourth relay 21 is, for example, an electromagnetic relay. The fourth relay 21 is provided between the second auxiliary terminal 17 and the O-phase terminal 15. The fourth relay 21, based on control by the controller 10, turns on and off the electrical connection between the second auxiliary terminal 17 and the O-phase terminal 15.

The fifth relay 22 is, for example, an electromagnetic relay. The fifth relay 22 is provided between the first output terminal 27 and the first auxiliary terminal 16. The fifth relay 22, based on control by the controller 10, turns on and off the electrical connection between the first output terminal 27 and the first auxiliary terminal 16.

The sixth relay 23 is, for example, an electromagnetic relay. The sixth relay 23 is provided between the second output terminal 28 and the second auxiliary terminal 17. The sixth relay 23, based on control by the controller 10, turns on and off the electrical connection between the second output terminal 28 and the second auxiliary terminal 17.

The first voltage sensor 24 detects a potential difference between the O-phase terminal 15 and the U-phase terminal 13. The first voltage sensor 24 notifies the detected potential difference to the controller 10. Note that the controller 10, which will be described later, may read out the potential difference detected by the first voltage sensor 24.

The second voltage sensor 25 detects a potential difference between the O-phase terminal 15 and the W-phase terminal 14. The second voltage sensor 25 notifies the detected potential difference to the controller 10. Note that the controller 10, which will be described later, may read out the potential difference detected by the second voltage sensor 25.

The third voltage sensor 26 detects a potential difference between the first output terminal 27 and the second output terminal 28. The third voltage sensor 26 notifies the detected potential difference to the controller 10. Note that the controller 10, which will be described later, may read out the potential difference detected by the third voltage sensor 26.

The controller 10 includes, for example, one or more processors and a memory. The processor may include a general-purpose processor for reading a particular program and performing a particular function, or a specialized processor dedicated to particular processing. The specialized processor may include an application-specific integrated circuit (ASIC: Application Specific Integrated Circuit). The processor may include a programmable logic device (PLD: Programmable Logic Device). The PLD may include an FPGA (Field-Programmable Gate Array). The controller 10 may be configured as a SoC (System-on-a-Chip) or a SiP (System In a Package) in which one or more processors cooperate.

The controller 10 acquires the potential difference between the O-phase terminal 15 and the U-phase terminal 13 from the first voltage sensor 24. The controller 10 also acquires the potential difference between the O-phase terminal 15 and the W-phase terminal 14 from the second voltage sensor 25. The controller 10 further acquires the potential difference between the first output terminal 27 and the second output terminal 28 from the third voltage sensor 26.

The controller 10 acquires various detection values and control instructions from various apparatuses. For example, the controller 10 communicates various information and control instructions with a power management apparatus installed in the customer facility, in which the distributed power supply 11 is installed. The controller 10 controls operation of each unit of the distributed power supply 11, based on acquired various information and control instructions.

For example, the controller 10 drives the AC power supply 12 based on the potential difference between the first output terminal 27 and the second output terminal 28 and causes the AC power supply 12 to output AC power having an adjusted voltage or the like. Also, the controller 10 controls the first relay 18, the second relay 19, the third relay 20, the fourth relay 21, the fifth relay 22, and the sixth relay 23 to turn on or off the electrical connections, based on control instructions received from the power management apparatus or the like.

The controller 10 outputs the same control signal to the third relay 20 and the fourth relay 21 in order to, for example, simplify the control and configuration. Thus, the controller 10 causes the third relay 20 and the fourth relay 21 to simultaneously turn on or off the electrical connections. Also, the controller 10 outputs the same control signal to the fifth relay 22 and the sixth relay 23 in order to, for example, simplify the control and configuration. Thus, the controller 10 causes the fifth relay 22 and the sixth relay 23 to simultaneously turn on or off the electrical connections.

The controller 10 can perform a welding check operation to check whether welding has occurred in the first relay 18, the second relay 19, the third relay 20, the fourth relay 21, the fifth relay 22, or the sixth relay 23. The controller 10 performs the welding check operation after the power grid GP has stopped supplying power due to, for example, a power outage of the power grid GP, and before an autonomous operation is started based on electric power supplied from the distributed power supply 11. The controller 10 performs the welding check operation after the power grid GP resumes power supply such as when, for example, the power outage of the power grid GP is resolved, and before a grid connection operation is started using the power grid GP.

When the power grid GP stops power supply, the controller 10 performs the welding check operation based on the potential difference detected by the first voltage sensor 24 and the second voltage sensor 25. When the power grid GP supplies electrical power, the controller performs the welding check operation based on the potential difference detected by the third voltage sensor 26.

In the welding check operation, the controller 10 first turns off the first relay 18, the second relay 19, the third relay 20, the fourth relay 21, the fifth relay 22, and the sixth relay 23. In the welding check operation, also, in a case in which the power grid GP has stopped power supply, the controller 10 drives the AC power supply 12 to output AC power. In the welding check operation, further, in a case in which the power grid GP has resumed power supply, the controller 10 causes the AC power supply 12 to stop outputting AC power.

In the welding check operation, the controller 10 performs a first welding check and a second welding check, which will be described below, in any order.

In the first welding check, the controller 10 checks whether welding has occurred in the second relay 19, by turning on the first relay 18.

In the first welding check while power supply from the power grid GP is stopped, when a difference between potential differences detected by the first voltage sensor 24 and the second voltage sensor 25 is equal to the voltage of AC power output from the AC power supply 12, the controller 10 determines that welding has occurred in the second relay 19. The controller 10 acquires the voltage of AC power output from the AC power supply 12, based on a voltage adjustment target value by the AC power supply 12 or a value detected by the third voltage sensor 26.

In the first welding check while the power grid GP supplies electric power, when the potential difference detected by the third voltage sensor 26 corresponds to the potential difference, e.g., 200V, between the U-phase and the W-phase of the power grid GP, the controller 10 determines that welding has occurred in the second relay 19. The controller 10 may apply the difference between the values detected by the first voltage sensor 24 and the second voltage sensor 25 to the potential difference between the U-phase and the W-phase.

In the second welding check, the controller 10 checks whether welding has occurred in the first relay 18, by turning on the second relay 19. In the second welding check while power supply from the power grid GP is stopped, when the difference between the potential differences detected by the first voltage sensor 24 and the second voltage sensor 25 is equal to the voltage of AC power output from the AC power supply 12, the controller 10 determines that welding has occurred in the first relay 18. Further, in the second welding check while the power grid GP supplies electrical power, when the potential difference detected by the third voltage sensor 26 corresponds to the potential difference, e.g., 200V, between the U-phase and the W-phase of the power grid GP, the controller 10 determines that welding has occurred in the first relay 18.

In the welding check operation, the controller 10 performs the first welding check and the second welding check in any order, and then performs a third welding check, a fourth welding check, a fifth welding check, and a sixth welding check. The controller 10 performs the third welding check before the fourth welding check, and also performs the fifth welding check before the sixth welding check.

For example, the controller 10 sequentially performs the third welding check, the fourth welding check, the fifth welding check, and the sixth welding check. For example, the controller 10 sequentially performs the third welding check, the fifth welding check, the sixth welding check, and the fourth welding check. For example, the controller 10 sequentially performs the third welding check, the fifth welding check, the fourth welding check, and the sixth welding check. For example, the controller 10 sequentially performs the fifth welding check, the sixth welding check, the third welding check, and the fourth welding check. For example, the controller sequentially performs the fifth welding check, the third welding check, the fourth welding check, and the sixth welding check. For example, the controller 10 sequentially performs the fifth welding check, the third welding check, the sixth welding check, and the fourth welding check.

In the third welding check, the controller 10 determines whether welding has occurred in the sixth relay 23, by turning on an in-phase relay, the third relay 20, and the fourth relay 21. The in-phase relay is one of the first relay 18 and the second relay 19 that is connected to the U-phase terminal 13 or the W-phase terminal 14, together with the third relay 20. In the present embodiment, the in-phase relay is the first relay 18.

In the third welding check while power supply from the power grid GP is stopped, when a potential difference between one of the U-phase terminal 13 and the W-phase terminal 14, which is connected to the in-phase relay, and the O-phase terminal 15 is equal to the voltage of AC power output from the AC power supply 12, the controller 10 determines that welding has occurred in the sixth relay 23. In the present embodiment, the U-phase terminal 13 is connected to the in-phase relay. Thus, the potential difference between the U-phase terminal 13 and the O-phase terminal 15 is detected by the first voltage sensor 24. Also, in the third welding check while the power grid GP supplies electric power, when the potential difference detected by the third voltage sensor 26 corresponds to the potential difference, i.e., 100 V, between the U-phase and the O-phase of the power grid GP, the controller 10 determines that welding has occurred in the sixth relay 23.

In the fourth welding check, the controller 10 determines whether welding has occurred in the fifth relay 22, by turning on an out-of-phase relay, the third relay 20, and the fourth relay 21. The out-of-phase relay is one of the first relay 18 and the second relay 19 that is not the in-phase relay. That is, the out-of-phase relay is one of the first relay 18 and second relay 19 that is not connected to the U-phase terminal 13 or the W-phase terminal 14, together with the third relay 20. The out-of-phase relay is the second relay 19 in the present embodiment.

In the fourth welding check while power supply from the power gird GP is stopped, when a difference between the potential differences detected by the first voltage sensor 24 and the second voltage sensor 25 corresponds to the voltage of AC power output from the AC power supply 12, the controller 10 determines that welding has occurred in the fifth relay 22. Also, in the fourth welding check while the power gird GP supplies electric power, when the potential difference detected by the third voltage sensor 26 corresponds to the potential difference, e.g. 200 V, between the U-phase and the W-phase of the power grid GP, the controller 10 determines that welding has occurred in the fifth relay 22.

In the fifth welding check, the controller 10 checks whether welding has occurred in the fourth relay 21, by turning on the in-phase relay, the fifth relay 22, and the sixth relay 23. In the fifth welding check while power supply from the power grid GP is stopped, when the potential difference between one of the U-phase terminal 13 and the W-phase terminal 14, which is connected to the in-phase relay, and the O-phase terminal 15 is equal to the voltage of AC power output from the AC power supply 12, the controller 10 determines that welding has occurred in the fourth relay 21. Also, in the fifth welding check while the power grid GP supplies electric power, when the potential difference detected by the third voltage sensor 26 corresponds to the potential difference, e.g. 100 V, between the U-phase and the O-phase of the power grid GP, the controller 10 determines that welding has occurred in the fourth relay 21.

In the sixth welding check, the controller 10 checks whether welding has occurred in the third relay 20, by turning on the out-of-phase relay, the fifth relay 22, and the sixth relay 23. In the sixth welding check while power supply from the power grid GP is stopped, when the difference between the potential differences detected by the first voltage sensor 24 and the second voltage sensor 25 corresponds to the voltage of AC power output from the AC power supply 12, the controller 10 determines that welding has occurred in the third relay 20. Also, in the sixth welding check while the power grid GP supplies electric power, when the potential difference detected by the third voltage sensor 26 corresponds to the potential difference, e.g. 200 V, between the U-phase and the W-phase of the power grid GP, the controller 10 determines that welding has occurred in the third relay 20.

When the controller 10 first determines that welding has occurred in any one of the first relay 18 to the sixth relay 23 during the first welding check to the sixth welding check, the controller 10 cancels the remaining welding checks.

When the controller 10 first determines that welding has occurred in any one of the first relay 18 to the sixth relay 23 during the first welding check to the sixth welding check, the controller 10 generates a notification signal. The notification signal indicates that welding has occurred in one of the first relay 18 to the sixth relay 23. The notification signal may include information specifying which one of the first relay 18 to the sixth relay 23 in which welding has occurred. The controller 10 outputs the notification signal to, for example, a remote controller 30 of the distributed power supply 11 or the power management apparatus.

Next, the welding check operation performed by the controller 10 while power supply from the power grid GP is stopped will be described with reference to the flowcharts of FIG. 2 and FIG. 3. The welding check operation performed while power supply from the power grid GP is stopped is started after the controller 10 detects a power outage of the power grid GP. The controller 10 detects the power outage of the power grid GP based on, for example, a voltage detected by the first voltage sensor 24, information acquired from the power management apparatus, or the like.

Figure 2:
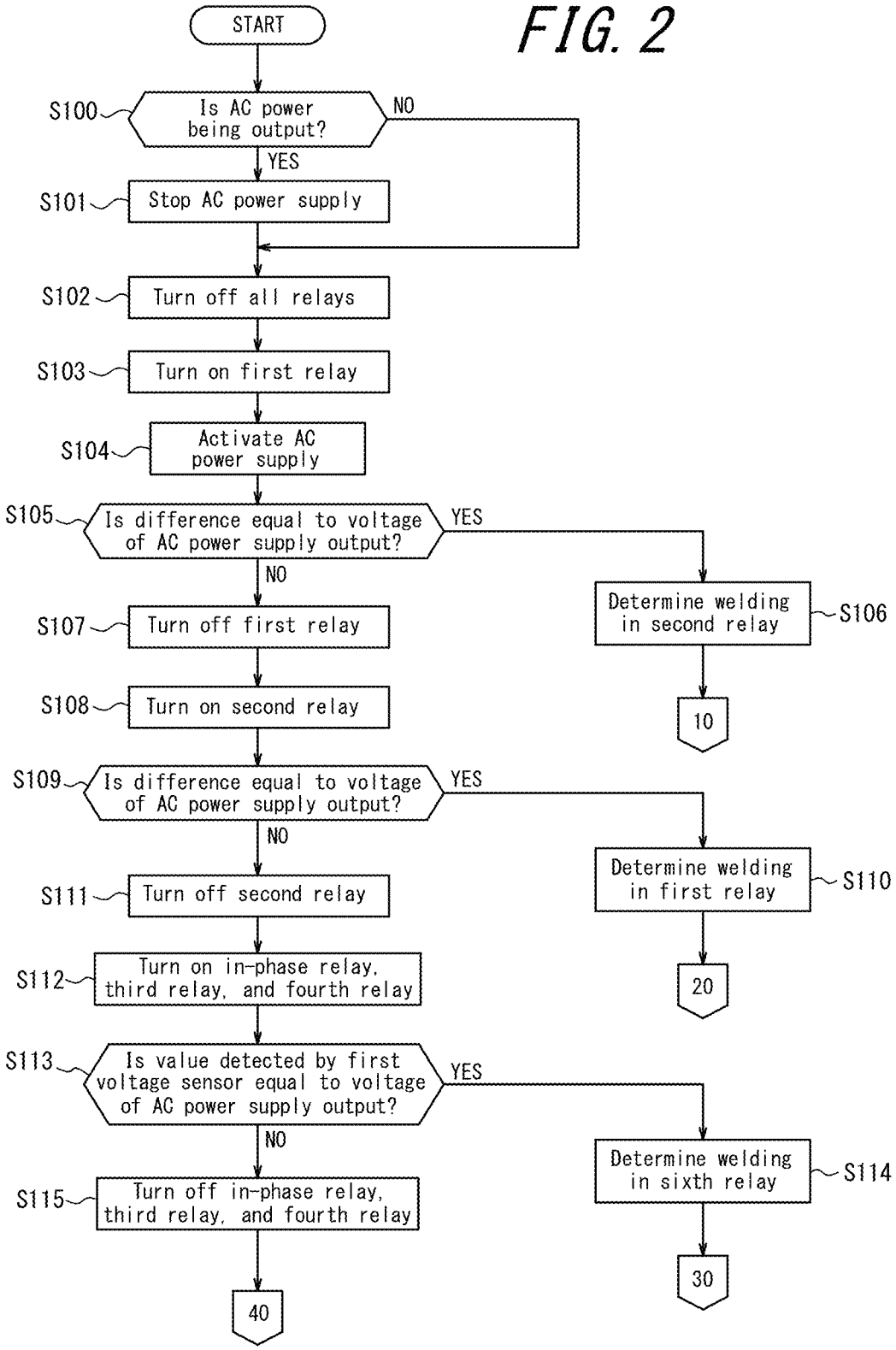
FIG. 2 is a first flow chart illustrating a welding check operation performed by a controller of FIG. 1 while power supply from a power grid is stopped.

In step S100, the controller 10 determines whether the AC power supply 12 is outputting AC power, as illustrated in FIG. 2. When the AC power supply 12 is outputting AC power, the process proceeds to step S101. When the AC power supply 12 is not outputting AC power, the process proceeds to step S102.

In step S101, the controller 10 causes the AC power supply 12 to stop outputting AC power. After stopping the AC power supply 12, the process proceeds to step S102.

In step S102, the controller 10 turns off all of the first relay 18 to the sixth relay 23. After turning off the relays, the process proceeds to step S103.

In step S103, the controller 10 turns on the first relay 18. After turning on the first relay 18, the process proceeds to step S104.

In step S104, the controller 10 activates the AC power supply 12 to output AC power. After activating the AC power supply 12, the process proceeds to step S105.

In step S105, the controller 10 determines whether the difference between the potential differences detected by the first voltage sensor 24 and the second voltage sensor 25 corresponds to the voltage of the AC power output from the AC power supply 12. After this determination, the controller 10 stops the AC power supply 12. When the difference corresponds to the voltage of AC power, the process proceeds to step S106. When the difference does not correspond to the voltage of AC power, the process proceeds to step S107.

In step S106, the controller 10 determines that welding has occurred in the second relay 19. After this determination, the process proceeds to step S128 (see FIG. 3).

In step S107, the controller 10 turns off the first relay 18. After turning off the first relay 18, the process proceeds to step S108.

In step S108, the controller 10 turns on the second relay 19. Further, the controller 10 activates the AC power supply 12. After turning on the second relay 19, the process proceeds to step S109.

In step S109, the controller 10 determines whether the difference between the potential differences detected by the first voltage sensor 24 and the second voltage sensor 25 corresponds to the voltage of AC power output from the AC power supply 12. After this determination, the controller 10 stops the AC power supply 12. When the potential difference corresponds to the voltage of AC power, the process proceeds to step S110. When the potential difference does not correspond to the voltage of AC power, the process proceeds to step S111.

In step S110, the controller 10 determines that welding has occurred in the first relay 18. After this determination, the process proceeds to step S128 (see FIG. 3).

In step S111, the controller 10 turns off the second relay 19. After turning off the second relay 19, the process proceeds to step S112.

In step S112, the controller 10 turns on the in-phase relay of the present embodiment, i.e., the first relay 18, the third relay 20, and the fourth relay 21. Further, the controller 10 activates the AC power supply 12. After turning on the in-phase relay, the third relay 20, and the fourth relay 21, the process proceeds to step S113.

In step S113, the controller 10 determines whether the potential difference detected by the first voltage sensor 24 corresponds to the voltage of AC power output from the AC power supply 12. After this determination, the controller 10 stops the AC power supply 12. When the potential difference corresponds to the voltage of AC power, the process proceeds to step S114. When the potential difference does not correspond to the voltage of AC power, the process proceeds to step S115.

In step S114, the controller 10 determines that welding has occurred in the sixth relay 23. After this determination, the process proceeds to step S128 (see FIG. 3).

In step S115, the controller 10 turns off the in-phase relay, the third relay 20, and the fourth relay 21. After turning off the in-phase relay, the third relay 20, and the fourth relay 21, the process proceeds to step S115 (see FIG. 3).

Figure 3:
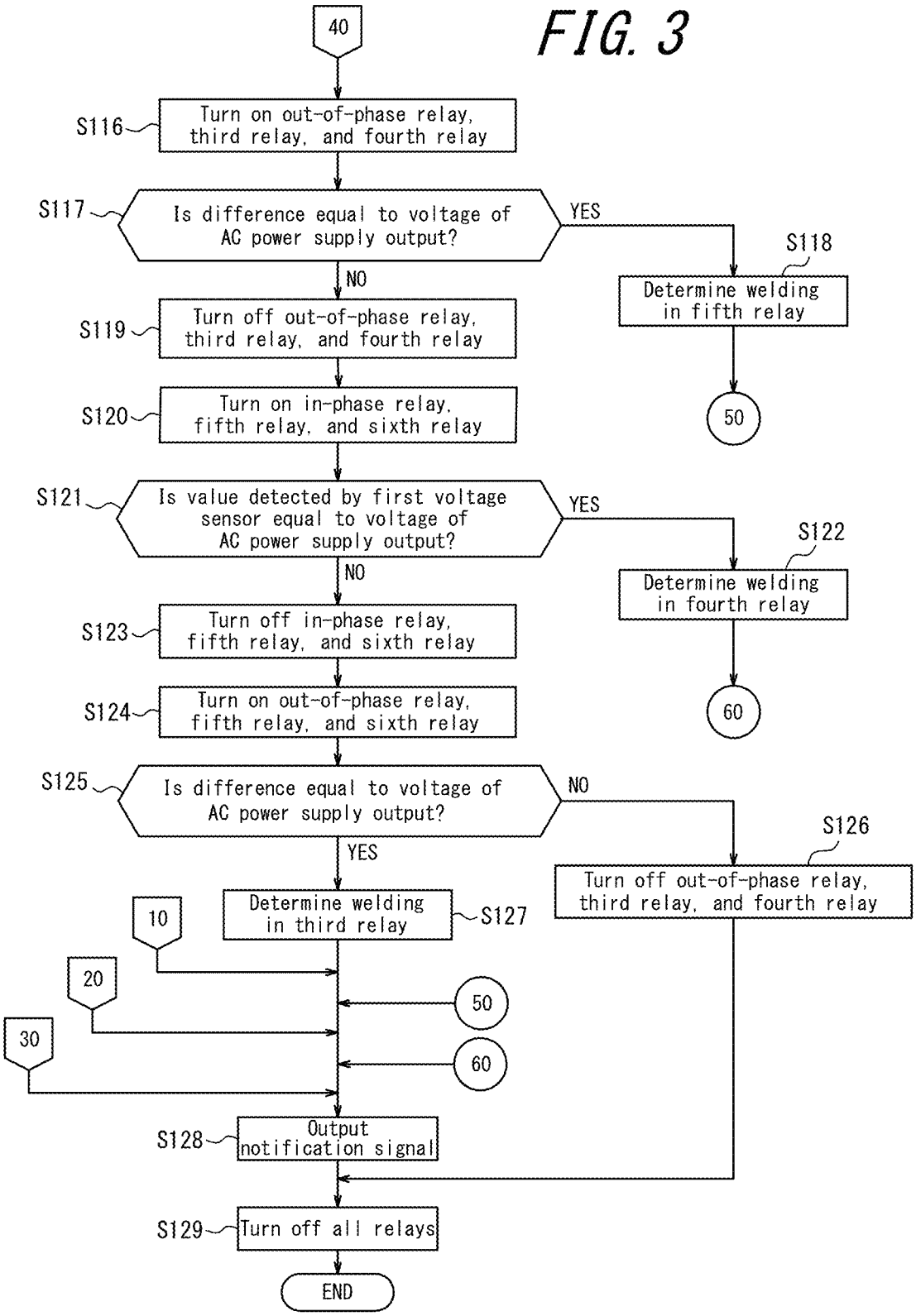
FIG. 3 is a second flow chart illustrating the welding check operation performed by the controller of FIG. 1 while power supply from the power grid is stopped.

In step S116, the controller 10 turns on the out-of-phase relay of the present embodiment, i.e., the second relay 19, the third relay 20, and the fourth relay 21, as illustrated in FIG. 3. Further, the controller 10 activates the AC power supply 12. After turning on the in-phase relay, the third relay 20, and the fourth relay 21, the process proceeds to step S117.

In step S117, the controller 10 determines whether the difference between the potential differences detected by the first voltage sensor 24 and the second voltage sensor 25 corresponds to the voltage of AC power output from the AC power supply 12. After this determination, the controller 10 stops the AC power supply 12. When the difference corresponds to the voltage of AC power, the process proceeds to step S118. When the difference does not correspond to the voltage of AC power, the process proceeds to step S119.

In step S118, the controller 10 determines that welding has occurred in the fifth relay 22. After this determination, the process proceeds to step S128.

In step S119, the controller 10 turns off the out-of-phase relay, the third relay 20, and the fourth relay 21. After turning off the out-of-phase relay, the third relay 20, and the fourth relay 21, the process proceeds to step S120.

In step S120, the controller 10 turns on the in-phase relay of the present embodiment, i.e., the first relay 18, the fifth relay 22, and the sixth relay 23. Further, the controller 10 activates the AC power supply 12. After tuning on the in-phase relay, the fifth relay 22, and the sixth relay 23, the process proceeds to step S121.

In step S121, the controller 10 determines whether the potential difference detected by the first voltage sensor 24 corresponds to the voltage of AC power output from the AC power supply 12. After this determination, the controller 10 stops the AC power supply 12. When the potential difference corresponds to the voltage of AC power, the process proceeds to step S122. When the potential difference does not correspond to the voltage of AC power, the process proceeds to step S123.

In step S122, the controller 10 determines that welding has occurred in the fourth relay 21. After this determination, the process proceeds to step S128.

In step S123, the controller 10 turns off the in-phase relay, the fifth relay 22, and the sixth relay 23. After turning off the in-phase relay, the fifth relay 22, and the sixth relay 23, the process proceeds to step S124.

In step S124, the controller 10 turns on the out-of-phase relay of the present embodiment, i.e., the second relay 19, the fifth relay 22, and the sixth relay 23. Further, the controller 10 activates the AC power supply 12. After turning on the out-of-phase phase relay, the fifth relay 22, and the sixth relay 23, the process proceeds to step S125.

In step S125, the controller 10 determines whether the difference between the potential differences detected by the first voltage sensor 24 and the second voltage sensor 25 corresponds to the voltage of AC power output from the AC power supply 12. After this determination, the controller 10 stops the AC power supply 12. When the difference does not correspond to the voltage of AC power, the process proceeds to step S126. When the difference corresponds to the voltage of AC power, the process proceeds to step S127.

In step S126, the controller 10 turns off the out-of-phase relay, the fifth relay 22, and the sixth relay 23. After turning off the out-of-phase relay, the fifth relay 22, and the sixth relay 23, the process proceeds to step S129.

In step S127, the controller 10 determines that welding has occurred in the third relay 20. After this determination, the process proceeds to step S127.

In step S128, the controller 10 generates a notification signal. Also, the controller 10 outputs the notification signal to the remote controller 30 of the distributed power supply 11 or the power management apparatus. After generation of the notification signal, the process proceeds to step S129.

In step S129, the controller 10 turns off all of the first relay 18 to the sixth relay 23. After turning off all of the relays, the welding check operation while power supply from the power grid GP is stopped is ended.

Next, the welding check operation performed by the controller 10 during power supply from the power grid GP will be described with reference to the flowcharts of FIG. 4 and FIG. 5. The welding check operation while the power grid GP supplies electric power starts after the controller 10 detects that the power grid GP has resumed power supply. The controller 10 detects that the power grid GP has resumed power supply, based on, for example, the potential difference detected by the first voltage sensor 24, information acquired from the power management apparatus, or the like.

Figure 4:
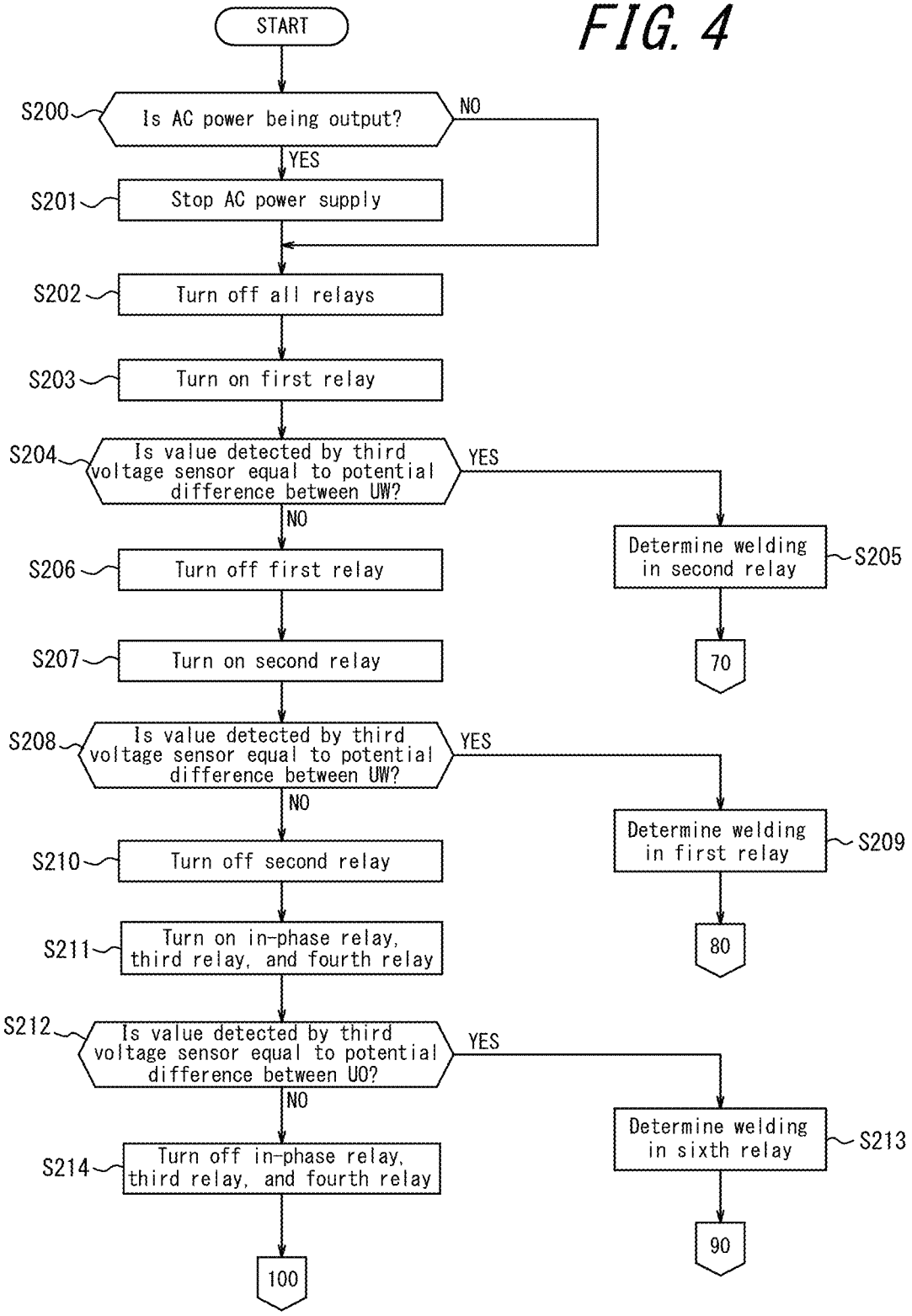
FIG. 4 is a first flow chart illustrating a welding check operation performed by the controller of FIG. 1 while the power grid supplies electric power.

In step S200, the controller 10 determines whether the AC power supply 12 is outputting AC power, as illustrated in FIG. 4. When the AC power supply 12 is outputting AC power, the process proceeds to step S201. When the AC power supply 12 is not outputting AC power, the process proceeds to step S202.

In step S201, the controller 10 stops the AC power supply 12. After stopping the AC power supply 12, the process proceeds to step S202.

In step S202, the controller 10 turns off all of the first relay 18 to the sixth relay 23. After turning them off, the process proceeds to step S203.

In step S203, the controller 10 turns on the first relay 18. After turning on the first relay 18, the process proceeds to step S204.

In step S204, the controller 10 determines whether the potential difference detected by the third voltage sensor 26 corresponds to the potential difference between the U-phase and the W-phase of the power grid GP. When the potential difference corresponds to the potential difference between the U-phase and the W-phase, the process proceeds to step S205. When the potential difference does not correspond to the potential difference between the U-phase and the W-phase, the process proceeds to step S206.

In step S205, the controller 10 determines that welding has occurred in the second relay 19. After this determination, the process proceeds to step S227 (see FIG. 5).

In step S206, the controller 10 turns off the first relay 18. After turning off the first relay 18, the process proceeds to step S207.

In step S207, the controller 10 turns on the second relay 19. After turning on the second relay 19, the process proceeds to step S208.

In step S208, the controller 10 determines whether the potential difference detected by the third voltage sensor 26 corresponds to the potential difference between the U-phase and the W-phase of the power grid GP. When the potential difference corresponds to the potential difference between the U-phase and the W-phase, the process proceeds to step S209. When the potential difference does not correspond to the potential difference between the U-phase and the W-phase, the process proceeds to step S210.

In step S209, the controller 10 determines that welding has occurred in the first relay 18. After this determination, the process proceeds to step S227 (see FIG. 5).

In step S210, the controller 10 turns off the second relay 19. After turning off the second relay 19, the process proceeds to step S211.

In step S211, the controller 10 turns on the in-phase relay of the present embodiment, i.e., the first relay 18, the third relay 20, and the fourth relay 21. After turning on the in-phase relay, the third relay 20, and the fourth relay 21, the process proceeds to step S212.

In step S212, the controller 10 determines whether the potential difference detected by the third voltage sensor 26 corresponds to the potential difference between the U-phase and the O-phase of the power grid GP. When the potential difference corresponds to the potential difference between the U-phase and the O-phase, the process proceeds to step S213. When the potential difference does not correspond to the potential difference between the U-phase and the O-phase, the process proceeds to step S214.

In step S213, the controller 10 determines that welding has occurred in the sixth relay 23. After this determination, the process proceeds to step S227 (see FIG. 5).

In step S214, the controller 10 turns off the in-phase relay, the third relay 20, and the fourth relay 21. After turning off the in-phase relay, the third relay 20, and the fourth relay 21, the process proceeds to step S215 (see FIG. 5).

Figure 5:
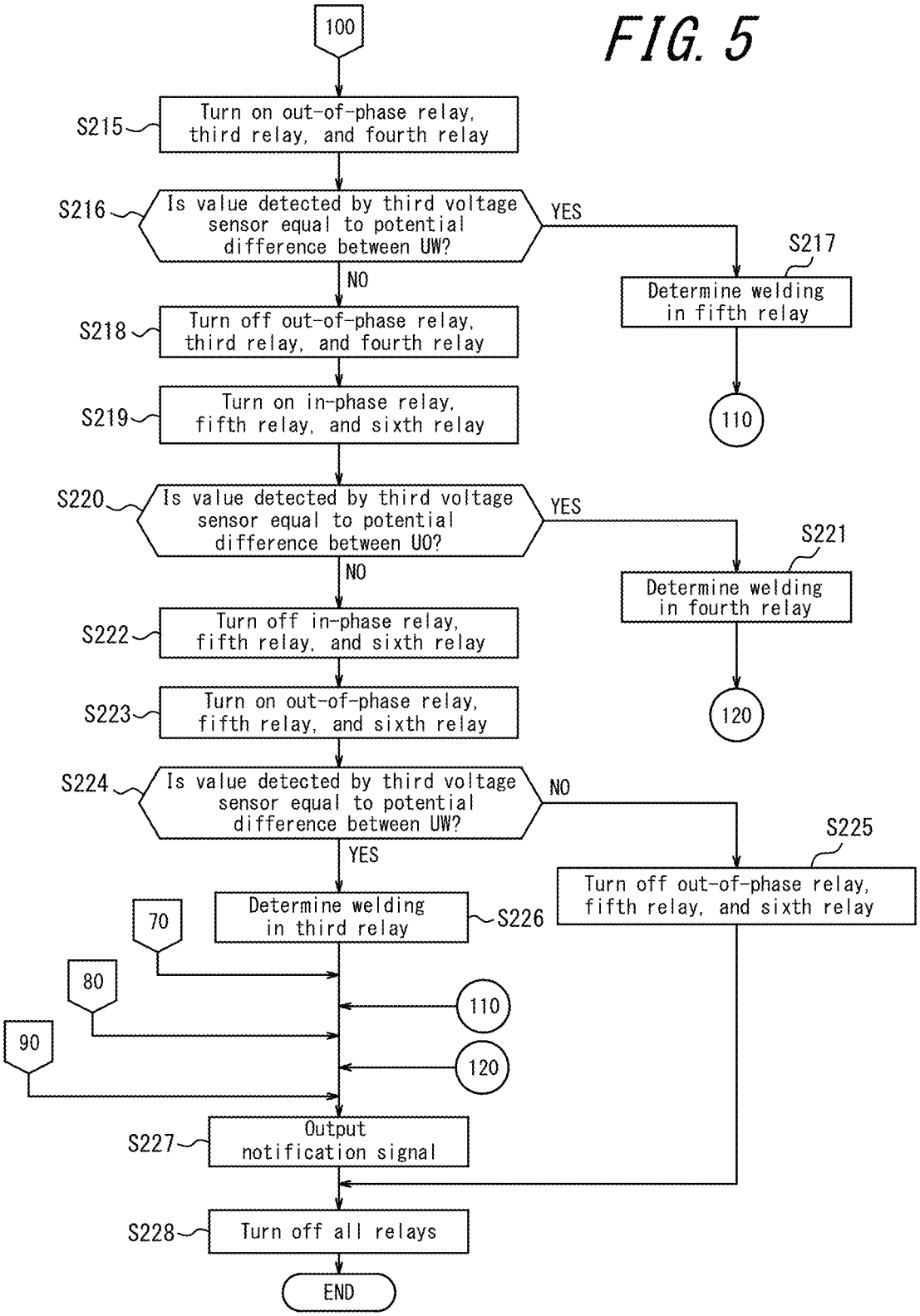
FIG. 5 is a first flow chart illustrating the welding check operation performed by the controller of FIG. 1 while the power grid supplies electric power.

In step S215, the controller 10 turns on the out-of-phase relay of the present embodiment, i.e., the second relay 19, the third relay 20, and the fourth relay 21, as illustrated in FIG. 5. After turning on the out-of-phase relay, the third relay 20, and the fourth relay 21, the process proceeds to step S216.

In step S216, the controller 10 determines whether the potential difference detected by the third voltage sensor 26 corresponds to the potential difference between the U-phase and the W-phase of the power grid GP. When the potential difference corresponds to the potential difference between the U-phase and the W-phase, the process proceeds to step S217. When the potential difference does not correspond to the potential difference between the U-phase and the W-phase, the process proceeds to step S218.

In step S217, the controller 10 determines that welding has occurred in the fifth relay 22. After this determination, the process proceeds to step S227.

In step S218, the controller 10 turns off the out-of-phase relay, the third relay 20, and the fourth relay 21. After turning off the out-of-phase relay, the third relay 20, and the fourth relay 21, the process proceeds to step S219.

In step S219, the controller 10 turns on the in-phase relay of the present embodiment, i.e., the first relay 18, the fifth relay 22, and the sixth relay 23. After turning on the first relay 18, the fifth relay 22, and the sixth relay 23, the process proceeds to step S220.

In step S220, the controller 10 determines whether the potential difference detected by the third voltage sensor 26 corresponds to the potential difference between the U-phase and the O-phase of the power grid GP. When the potential difference corresponds to the potential difference between the U-phase and the O-phase, the process proceeds to step S221. When the potential difference does not correspond to the potential difference between the U-phase and the O-phase, the process proceeds to step S222.

In step S221, the controller 10 determines that welding has occurred in the fourth relay 21. After this determination, the process proceeds to step S227.

In step S222, the controller 10 turns off the in-phase relay, the fifth relay 22, and the sixth relay 23. After turning off the in-phase relay, the fifth relay 22, and the sixth relay 23, the process proceeds to step S223.

In step S223, the controller 10 turns on the out-of-phase relay of the present embodiment, i.e., the second relay 19, the fifth relay 22, and the sixth relay 23. After turning on the out-of-phase relay, the fifth relay 22, and the sixth relay 23, the process proceeds to step S224.

In step S224, the controller 10 determines whether the potential difference detected by the third voltage sensor 26 corresponds to the potential difference between the U-phase and the W-phase of the power grid GP. When the potential difference does not correspond to the potential difference between the U-phase and the W-phase, the process proceeds to step S225. When the potential difference corresponds to the potential difference between the U-phase and the W-phase, the process proceeds to step S226.

In step S225, the controller 10 turns off the out-of-phase relay, the fifth relay 22, and the sixth relay 23. After turning off the out-of-phase relay, the fifth relay 22, and the sixth relay 23, the process proceeds to step S228.

In step S226, the controller 10 determines that welding has occurred in the third relay 20. After this determination, the process proceeds to step S227.

In step S227, the controller 10 generates a notification signal. Further, the controller 10 outputs the notification signal to the remote controller 30 of the distributed power supply 11 or the power management apparatus. After generating the notification signal, the process proceeds to step S228.

In step S228, the controller 10 turns off all of the first relay 18 to the sixth relay 23. After turning them off, the welding check operation during power supply from the power grid GP ends.

The controller 10 of the present embodiment configured as described above performs the first welding check and the second welding check in any order, then performs the third welding check before the fourth welding check, and also performs the fifth welding check before the sixth welding check. The effects of this configuration will be described below.

In a case in which welding has occurred in the second relay 19 while the first relay 18 is turned on, regardless of the presence or absence of welding in any one of the third relay 20 to the sixth relay 23, the potential of the first output terminal 27 and the potential of the U-phase terminal are equal to each other, and the potential of the second output terminal 28 and the potential of the W-phase terminal 14 are equal to each other. Thus, in a case in which welding has occurred in the second relay 19, regardless of the presence or absence of welding occurred in any one of the third relay 20 to the sixth relay 23, while power supply from the power grid GP is stopped, the difference between the potential differences detected by the first voltage sensor 24 and the second voltage sensor 25 is equal to the voltage of AC power output from the AC power supply 12. Further, when welding has occurred in the second relay 19, regardless of the presence or absence of welding in any one of the third relay 20 to the sixth relay 23, while the power grid GP supplies electric power, the voltage detected by the third voltage sensor 26 is equal to the potential difference between the U-phase and the W-phase.

Similarly, in a case in which welding has occurred in the first relay 18 while the second relay 19 is turned on, regardless of the presence or absence of welding in any one of the third relay 20 to the sixth relay 23, the potential of the first output terminal 27 and the potential of the U-phase terminal 13 are equal to each other, and the potential of the second output terminal 28 and the potential of the W-phase terminal 14 are equal to each other. Thus, in a case in which welding has occurred in the first relay 18, regardless of the presence or absence of welding in any one of the third relay 20 to the sixth relay 23, while power supply from the power grid GP is stopped, the difference between the potential differences detected by the first voltage sensor 24 and the second voltage sensor 25 is equal to the voltage of AC power output from the AC power supply 12. Further, when welding has occurred in the first relay 18, regardless of the presence or absence of welding occurred in any one of the third relay 20 to the sixth relay 23, while the power grid GP supplies electric power, the voltage detected by the third voltage sensor 26 is equal to the potential difference between the U-phase and the W-phase.

Thus, the controller 10 according to the present embodiment can determine whether welding has occurred in the second relay 19 or the first relay 18, regardless of the presence or absence of welding in any one of the third relay 20 to the sixth relay 23, by performing the first welding check in which the first relay 18 is turned on and performing the second welding check in which the second relay 19 is turned on.

Further, in a case in which welding has occurred in the sixth relay 23 while the third relay 20 and the fourth relay 21 are turned on, regardless of the presence or absence of welding in the fifth relay 22, the potential of the first output terminal 27 and the potential of the U-phase terminal 13 are equal to each other, and the potential of the second output terminal 28 and the potential of the O-phase terminal 15 are equal to each other. Thus, in a case in which welding has occurred in the sixth relay 23, regardless of the presence or absence of welding in the fifth relay 22, while power supply from the power grid GP is stopped, the potential difference detected by the first voltage sensor 24 is equal to the voltage of AC power output from the AC power supply 12. Also, in a case in which welding has occurred in the sixth relay 23, regardless of the presence or absence of welding in the fifth relay 22, while the power grid GP supplies electric power, the voltage detected by the third voltage sensor 26 is equal to the potential difference between the U-phase and the O-phase.

Thus, the controller 10 according of the present embodiment can determine whether welding has occurred in the sixth relay 23, regardless of the presence or absence of welding in the fifth relay 22, by performing the third welding check in which the in-phase relay, the third relay 20, and the fourth relay 21 are turned on, after determining that welding has not occurred in the second relay 19 in the first welding check. Even if it is determined in the third welding check that welding has occurred in the fifth relay 22, the U-phase terminal is connected to the first output terminal 27 via the path through the in-phase relay and also via the path through the third relay 20 and the fifth relay 22. Thus, a short circuit does not occur in the third welding check.

Further, in a case in which welding has occurred in the fifth relay 22 while the out-of-phase relay, the third relay 20, and the fourth relay 21 are turned on, the potential of the first output terminal 27 and the potential of the U-phase terminal 13 are equal to each other, and the potential of the second output terminal 28 and the potential of the W-phase terminal 14 are equal to each other. Thus, in a case in which welding has occurred in the fifth relay 22, while the power grid GP stops power supply, the difference between the potential differences detected by the first voltage sensor 24 and the second voltage sensor 25 is equal to the voltage of AC power output from the AC power supply 12. Also, in a case in which welding has occurred in the fifth relay 22, while the power grid GP supplies electric power, the voltage detected by the third voltage sensor 26 is equal to the potential difference between the U-phase and the W-phase.

Thus, the controller 10 according to the present embodiment can determine whether welding has occurred in the fifth relay 22, by performing the second welding check for determining whether welding has occurred in the first relay 18, and the third welding check for determining whether welding has occurred in the sixth relay 23, and then performing the fourth welding check by turning on the out-of-phase relay, the third relay 20, and the fourth relay 21. By performing the third welding check before the fourth welding check, the controller 10 can prevent a short circuit between the O-phase terminal 15 and the W-phase terminal 14 when the electrical connection by the out-of-phase relay, the fourth relay 21, and the sixth relay 23 are turned on.

Further, in a case in which welding has occurred in the fourth relay 21, while the in-phase relay, the fifth relay 22, and the sixth relay 23 are turned on, regardless of the presence or absence of welding in the third relay 20, the potential of the first output terminal 27 and the potential of the U-phase terminal 13 are equal to each other, and the potential of the second output terminal 28 and the potential of the O-phase terminal 15 are equal to each other. Thus, when welding has occurred in the fourth relay 21, regardless of the presence or absence of welding in the third relay 20, while power supply from the power grid GP is stopped, the potential difference detected by the first voltage sensor 24 is equal to the voltage of AC power output from the AC power supply 12. Further, when welding has occurred in the fourth relay 21, regardless of the presence or absence of welding in the third relay 20, while the power grid GP supplies electric power, the voltage detected by the third voltage sensor 26 is equal to the potential difference between the U-phase and the O-phase.

Thus, the controller 10 according to the present embodiment can determine whether welding has occurred in the fourth relay 21, regardless of the presence or absence of welding in the third relay 20, by performing the first welding check for determining whether welding has occurred in the second relay 19, and the fifth welding check for turning on the in-phase relay, the fifth relay 22, and the sixth relay 23. Even if it is determined in the fifth welding check that welding has occurred in the third relay 20, the U-phase terminal 13 is connected to the first output terminal 27 via the path through the in-phase relay and also via the path through the third relay 20 and the fifth relay 22. Thus, a short circuit does not occur in the fifth welding check.

Further, in a case in which welding has occurred in the third relay 20, while the out-of-phase relay, the fifth relay 22, and the sixth relay 23 are turned on, the potential of the first output terminal 27 and the potential of the U-phase terminal 13 are equal to each other, and the potential of the second output terminal 28 and the potential of the W-phase terminal 14 are equal to each other. Accordingly, in a case in which welding has occurred in the third relay 20, while power supply form the power grid GP is stopped, the difference between the potential differences detected by the first voltage sensor 24 and the second voltage sensor 25 is equal to the voltage of AC power output from the AC power supply 12. Also, in a case in which welding has occurred in the third relay 20, while the power grid GP supplies electric power, the voltage detected by the third voltage sensor 26 is equal to the potential difference between the U-phase and the W-phase.

Thus, the controller 10 according to the present embodiment can determine whether welding has occurred in the fourth relay 21, by performing the sixth welding check in which the out-of-phase relay, the fifth relay 22, and the sixth relay 23 are turned on, after determining that welding has not occurred in the first relay 18 in the second welding check and determining that welding has occurred in the sixth relay 23 in the third welding check. Because the controller 10 performs the fifth welding check before the sixth welding check, the controller 10 can prevent a short circuit between the O-phase terminal 15 and the W-phase terminal 14 when the out-of-phase relay, the fourth relay 21, and the sixth relay 23 are turned on.

As described above, the controller 10 according to the present embodiment can determine whether welding has occurred in any one of a plurality of relays using detection results from fewer sensors than are conventionally used.

When the controller 10 according to the present embodiment first determines that welding has occurred in any one of the first relay 18 to the sixth relay 23, the controller 10 cancels the remaining welding checks. Thus, the controller 10 cancels unnecessary welding checks that do not enable determination of the occurrence of welding in other relays, and thus prevents a short circuit occurring within the distributed power supply 11 which would be caused by performing the remaining welding checks after the determination that welding has occurred.

The controller 10 according to the present embodiment outputs a notification signal when the controller 10 determines that welding has occurred in any one of the first relay 18 to the sixth relay 23. Thus, the controller 10 can notify a user that the distributed power supply 11 needs to be repaired.

Although the present disclosure has been described based on the drawings and embodiments, it should be appreciated that those who are skilled in the art may easily perform variations or alterations based on the present disclosure. Accordingly, such variations and alterations are to be included in the scope of the present disclosure.

For example, although the controller 10 of the present embodiment is included in the distributed power supply 11, the controller 10 does not need to be included in the distributed power supply 11 and may be provided external to the distributed power supply 11.

Further, although the controller 10 of the present embodiment generates a notification signal when the controller 10 first determines the occurrence of welding, a notification signal may be generated in advance and output by the controller 10 when the controller 10 first determines that welding has occurred in any one of the first relay 18 to the sixth relay 23.

Further, the controller 10 of the present embodiment stops the AC power supply 12 before turning off each of the relays in respective steps S107, S111, S115, S119, S123, and S126, and activates the AC power supply 12 after turning on each of the relays in respective steps S108, S112, S116, S120, and S124. However, the controller 10 does not need to stop the AC power supply 12 before turning off each of the relays and activate the AC power supply 12 after turning on each of the relays. The controller 10 may maintain the drive of the AC power supply 12 after step S104.

Note that the system disclosed herein includes various modules and/or units for executing specific functions, and the modules and/or the units are schematically illustrated for the purpose of brief description of functionality thereof and do not necessarily represent specific hardware and/or software. In that sense, these modules, units, and other components may be any hardware and/or software implemented to substantially execute the specific functions described herein. Various functions of different components may be substantialized by combining or separating the hardware and/or the software in any manner, and may be used separately or in any combination. Further, an input/output or I/O device and a user interface may be a keyboard, a display, a touch screen, a pointing device, and the like but not limited thereto, and may be connected to the system directly, or via an intermediating I/O controller. As described above, various aspects of the disclosure herein may be realized in various embodiments, and all the various embodiments are included in the scope of the disclosure herein.

The invention claimed is:

1. A controller capable of turning on and off a first relay provided between a first output terminal of an AC power supply and a U-phase terminal connected to a power grid, a second relay provided between a second output terminal having a different polarity from the first output terminal and a W-phase terminal connected to the power grid, a third relay provided between a first auxiliary terminal connected to an auxiliary apparatus and the U-phase terminal or the W-phase terminal, a fourth relay provided between a second auxiliary terminal having a different polarity from the first auxiliary terminal and an O-phase terminal connected to the power grid, a fifth relay provided between the first output terminal and the first auxiliary terminal, and a sixth relay provided between the second output terminal and the second auxiliary terminal, wherein the controller is configured to perform:

a first welding check by turning on the first relay and a second welding check by turning on the second relay, in any order;

a third welding check by turning on an in-phase relay, which is one of the first relay and the second relay that is connected to the U-phase terminal or the W-phase together with the third relay, the third relay, and the fourth relay, before performing a fourth welding check by turning on an out-of-phase relay, which is one of the first relay and the second relay that is not the in-phase relay, the third relay, and the fourth relay; and a fifth welding check by turning on the in-phase relay, the fifth relay, and the sixth relay, before performing a sixth welding check by turning on the out-of-phase relay, the fifth relay, and the sixth relay.

2. The controller according to claim 1, configured to:

cancel remaining welding checks out of the first welding check to the sixth welding check, when the controller first determines that welding has occurred in any one of the first relay to the sixth relay while performing any one of the first welding check to the sixth welding check.

3. The controller according to claim 1, configured to:

output a notification signal indicating that welding has occurred, when the controller determines that welding has occurred in any one of the first relay to the sixth relay while performing any one of the first welding check to the sixth welding check.

4. The controller according to claim 1, configured to:

perform the first welding check, the second welding check, the fourth welding check, and the sixth welding check, based on a potential difference between the U-phase terminal and the W-phase terminal, or based on a potential difference between the first output terminal and the second output terminal, and perform the third welding check and the fifth welding check, based on a potential difference between the O-phase terminal and one of the U-phase terminal and the W-phase terminal that is connected to the in-phase relay, or based on a potential difference between the first output terminal and the second output terminal.

5. The controller according to claim 4, configured to:

perform the first welding check, the second welding check, the fourth welding check, and the sixth welding check, based on the potential difference between the U-phase terminal and the W-phase terminal, and perform the third welding check and the fifth welding check, based on the potential difference between the O-phase terminal and one of the U-phase terminal and the W-phase terminal that is connected to the in-phase relay, when power supply from the power grid is stopped, and perform the first welding check to the sixth welding check, based on the potential difference between the first output terminal and the second output terminal, when the power grid supplies electric power.

6. A distributed power supply comprising:

an AC power supply that includes a first output terminal and a second output terminal having a different polarity from the first output terminal;

a U-phase terminal, a W-phase terminal, and an O-phase terminal that are connected to the power grid;

a first auxiliary terminal connected to an auxiliary apparatus, and a second auxiliary terminal having a different polarity from the first auxiliary terminal;

a first relay provided between the first output terminal and the U-phase terminal;

a second relay provided between the second output terminal and the W-phase terminal;

a third relay provided between the first auxiliary terminal and the U-phase terminal or the W-phase terminal;

a fourth relay provided between the second auxiliary terminal and the O-phase terminal;

a fifth relay provided between the first output terminal and the first auxiliary terminal;

a sixth relay provided between the second output terminal and the second auxiliary terminal; and a controller configured to perform a first welding check by turning on the first relay and a second welding check by turning on the second relay, in any order, and then perform a third welding check by turning on an in-phase relay, which is one of the first relay and the second relay that is connected to the U-phase terminal or the W-phase together with the third relay, the third relay, and the fourth relay, before performing a fourth welding check by turning on an out-of-phase relay, which is one of the first relay and the second relay that is not the in-phase relay, the third relay, and the fourth relay, and then perform a fifth welding check by turning on the in-phase relay, the fifth relay, and the sixth relay, before performing a sixth welding check by turning on the out-of-phase relay, the fifth relay, and the sixth relay.

7. A method for checking welding in a first relay provided between a first output terminal of an AC power supply and a U-phase terminal connected to power grid, a second relay provided between a second output terminal having a different polarity from the first output terminal and a W-phase terminal connected to the power grid, a third relay provided between a first auxiliary terminal connected to an auxiliary apparatus and the U-phase terminal or the W-phase terminal, a fourth relay provided between a second auxiliary terminal having a different polarity from the first auxiliary terminal and an O-phase terminal connected to the power grid, a fifth relay provided between the first output terminal and the first auxiliary terminal, and a sixth relay provided between the second output terminal and the second auxiliary terminal, the method comprising:

performing a first welding check by turning on the first relay and a second welding check by turning on the second relay, in any order;

performing a third welding check by turning on an in-phase relay, which is one of the first relay and the second relay that is connected to the U-phase terminal or the W-phase together with the third relay, the third relay, and the fourth relay, before performing a fourth welding check by turning on an out-of-phase relay, which is one of the first relay and the second relay that is not the in-phase relay, the third relay, and the fourth relay; and performing a fifth welding check by turning on the in-phase relay, the fifth relay, and the sixth relay, before performing a sixth welding check by turning on the out-of-phase relay, the fifth relay, and the sixth relay.

* * * * *